US005235646A

United States Patent [19]

Wilde et al.

[11] Patent Number: 5,235,646

[45] Date of Patent: Aug. 10, 1993

[54] METHOD AND APPARATUS FOR CREATING DE-CORRELATED AUDIO OUTPUT SIGNALS AND AUDIO RECORDINGS MADE THEREBY

[76] Inventors: Martin D. Wilde, 1516 W. Thorndale, #3E, Chicago, Ill. 60660; William L. Martens, 807 Church St., #503, Evanston, Ill. 60201; Gary S. Kendall, 2111 Madison Pl., Evanston, Ill. 60202

[21] Appl. No.: 538,544

[22] Filed: Jun. 15, 1990

[51] Int. Cl.[5] ..... H04S 5/00

[52] U.S. Cl. ..... 381/17; 381/97

[58] Field of Search ..... 381/17, 97, 1

[56] References Cited

U.S. PATENT DOCUMENTS

| | | | |
|---|---|---|---|
| 3,670,106 | 6/1972 | Orban . | |
| 4,121,059 | 10/1978 | Nakabayashi . | |
| 4,308,424 | 12/1981 | Bice, Jr. . | |
| 4,706,287 | 11/1987 | Blackmer et al. | 381/63 |
| 4,731,848 | 3/1988 | Kendall et al. . | |
| 4,817,162 | 3/1989 | Kihara | 381/1 |
| 4,972,489 | 11/1990 | Oki et al. . | |

FOREIGN PATENT DOCUMENTS

| | | | |
|---|---|---|---|
| 1512059 | 2/1968 | France | 38/17 |
| 58-190199 | 11/1983 | Japan | 381/17 |
| 942459 | 11/1963 | United Kingdom | 381/17 |

OTHER PUBLICATIONS

Kohichi Kurozumi, et al., "The Relationship between the Cross-Correlation Coefficient of Two-Channel Accoustic Signals and Sound Image Quality", *J. Acoust. Soc. Am.*, 74 (6), Dec. 1983, pp. 1726–1733.

U.S. Pat. App. by Kendall et al., "Apparatus and Method for Controlling the Magnitude Spectrum of Accoustically Combined Signals" (Filed Jun. 15, 1990), Ser. No. 538,547.

U.S. Pat. App. by Kendall et al., "Method for Eliminating the Precedence Effect in Stereophonic Sound System and Recording Made with Said Method" (Filed Jun. 15, 1990), Ser. No. 538,543.

U.S. Pat. App. by Wilde et al., "Method for Controlling the Width and Distance of an Acoustic Image" (Filed Jun. 15, 1990), Ser. No. 538,400).

U.S. Pat. App. by Wilde et al., "Improved Audio Processing System and Recordings Made Thereby" (Filed Jun. 15, 1990) Ser. No. 538,548.

Translation of Kurozumi (Japan 58-190199).

*Primary Examiner*—Forester W. Isen

[57] ABSTRACT

An apparatus and method for generating audio output signals having a specified cross-correlation relationships is disclosed. The apparatus operates by phase-shifting different frequency bands of an input signal by differing amounts which depend on the desired cross-correlation. The amplitude spectrum of the input signal is not altered.

23 Claims, 2 Drawing Sheets

METHOD AND APPARATUS FOR CREATING DE-CORRELATED AUDIO OUTPUT SIGNALS AND AUDIO RECORDINGS MADE THEREBY

BACKGROUND OF THE INVENTION

The present invention relates to the field of acoustics and, more particularly, to the processing of audio signals to provide control over the cross-correlation of a pair of audio output signals.

The interaural cross-correlation of the signals reaching the ears of a listener has long been recognized as an important acoustic predictor of subjective sound properties. It is especially relevant for concert halls, for which a low interaural cross-correlation gives rise to the highly desired sound quality of "spaciousness"[Schroeder, M. R., Gottlob, D., and Siebrasse, K. F., "Comparative study of European Concert Halls: Correlation of Subjective Preference with Geometric and Acoustic Parameters", *Journal of the Acoustical Society of America* 56, pp. 1195–1201 (1974); Ando, Y., "Subjective Preference in Relation to Objective Parameters of Music Sound Fields with a Single Echo", *Journal of the Acoustical Society of America* 62, pp 1436–1441, (1977)]. It has also been demonstrated that the cross-correlation coefficient of two noise signals presented to listeners was strongly correlated with the perceptual width and distance of the acoustical image [Kurozumi, K. and Ohgushi, K., "The Relationship Between the Cross-correlation Coefficient of Two-channel Acoustic Signals and Sound image Quality", *Journal of the Acoustical Society of America* 74, pp. 1728–1733 (1983)]. Image distance is directly correlated with the value of the cross-correlation coefficient, and image width is inversely correlated to the absolute value of the cross-correlation coefficient. These authors have also shown that the absolute effect of cross-correlation coefficient is greater for low frequencies (below 1KHz) than for high frequencies (above 3Khz).

The cross-correlation of two signals, $y_1(t)$ and $y_2(t)$, is typically measured in terms of a cross-correlation measure which is defined to be the extreme value of the cross-correlation function $\Omega(x)$, where $$\Omega(x) = \lim_{T \to \infty} 1/(2T) \int_{-T}^{T} y_1(t) y_2(t + x) dt \quad (1)$$

The cross-correlation measure has a maximum possible value of 1 and a minimum possible value of $-1$.

The cross-correlation measure of the output signals of an apparatus will typically be very close to the interaural cross-correlation of the signals reaching the ears of the listener when sound is produced by loudspeakers or headphones. The actual interaural cross-correlation will be somewhat dependent on the characteristics of the reproduction environment. For example, room reverberation will tend to shift the interaural cross-correlation toward zero.

Prior art systems which produce acoustical effects and manipulate the cross-correlation measure are known to those skilled in the art. For example, such systems have been used to broaden the image of stereophonic input signals.

Shimada (U.S. Pat. No. 3,892,624) and Doi, et al. (U.S. Pat. No. 4,069,394) describe a stereophonic reproduction system in which portions of the input signals are scaled by a constant, k, and cross-fed in 180-degree out-of-phase relationships. That is, given left and right input signals $a_l(t)$ and $a_r(t)$, left and right output signals $L = a_l(t) - ka_r(t)$ and $R = a_r(t)$ are generated. When L and R are presented over two loudspeakers, a listener located between the loudspeakers perceives a broadened sound image.

Cohn (U.S. Pat. No. 4,355,203) teaches a method for providing signal decorrelation in which a time delay is utilized. In this system $L = a_l(t) - ka_r(t - T_d)$ and $R = a_r(t) - ka_l(t - T_d)$, where $T_d$ is the time delay in question.

The above mentioned systems and systems based on similar techniques all manipulate the cross-correlation of the output signals. It should be noted, however that the authors of these references do not characterize the operation of their various apparatuses as cross-correlation measure manipulation apparatuses.

These prior art methods for manipulating the cross-correlation measure have a number of problems. For example, consider the case of a single sound element (such as a monophonic track from a mixing console or tape recorder) shared by the stereo input channels in some ratio, L:R. The cross-correlation measure at the output channels will be either positive one or negative one depending on the L:R ratio and the relative gain, k, of the cross-fed, out-of-phase signals. Input signals which contain a multiplicity of such single sound elements produce an output which can be viewed as a strict summation of the output of each single sound element. Given that these systems are designed to process input signals with multiple sound elements (each with its own L:R ratio), the final result is greatly dependent on the program material. Furthermore, center images are less intense than side images. When the L:R ratio of the program material is equal to one, $a_l(t)$ equals $a_r(t)$ and the subtraction of signals in each channel results in a loss of intensity in each output. Hence, these systems do not work well for all types of program material.

Furthermore, the range of cross-correlation measure values that can be generated utilizing these techniques is restricted to a small range of the possible cross-correlation measure values. It can be shown that cross-correlation measure values outside the ranges produced by these techniques may be advantageously utilized to provide acoustical effects.

Another problem with these types of systems is the colorization added to the final output signal. The summation of the signals used to provide the output signals results in constructive and destructive interference. This interference alters the perceived timbre of the sound. In addition, the interaural phase relationship at the listener's ears is highly dependent on the listener's location relative to the loudspeakers and causes listeners at these locations to hear quite different effects in timbre, image width, and image distance.

Another type of system that manipulates the cross-correlation of the output signals is taught by Orban (U.S. Pat. No. 3,670,106). The apparatus taught by Orban is utilized in converting a monophonic sound signal to stereophonic sound signals. In this system, the monophonic sound signal is processed with an all-pass filter to form a second signal with an added phase shift. The phase shift in question varies slowly as a function of the frequency of the monophonic signal. The second signal is then added to and subtracted from the original monophonic sound signal to produce left and right stereophonic speaker signals, respectively.

These left and right speaker signals are the result of the constructive and destructive interference of the original monophonic signal with the second, all-pass filtered signal. The phase of the all-pass processed signal determines the magnitude and phase response of the output signals. A comparison of the magnitude response of the output signals across frequency reveals that when the left magnitude response is at a maximum, the right magnitude response is at a minimum and vice versa. This helps to reduce the timbral coloration. A comparison of the phase response also reveals a similar complementary relationship. Therefore, it can be seen that this system uses both inter-channel amplitude and phase differences to steer the sound image from side to side. The effect of the system is achieved primarily through differences in the magnitude of the channels rather than through phase differences. The author points out that "very slight phase shifts" are utilized. Viewed from the standpoint of the psychoacoustic phenomenon of time-intensity trading, the large magnitude differences ($\infty$dB at "cross-over frequencies") overwhelm the impact of the slight inter-channel phase differences (approximately $\pi/10$ in the preferred embodiment).

A "third control element" is mentioned which adjusts "the channel separation from pure, completely in-phase monophonic to pure, random phase stereo." In regards to the "random phase stereo", this statement is neither supported nor is it true. The phase shifts created by this system in the individual output signals are not random but occur in a repeated pattern centered at each of the predetermined "cross-over points." Then too, magnitude differences are dominating the phase differences.

One problem with this system is that the complementary maxima and minima of the magnitude response cause coloration for a listener located closer to one loudspeaker than the other.

Furthermore, the range of cross-correlation measure values that can be generated utilizing this system is restricted to a small range of the possible values. It can be shown that cross-correlation values outside the range provided by this system may be advantageously utilized to provide acoustical effects.

Although this system creates the illusion of a broadened sound image, the image in question is less than ideal. The slow variation of the phase shift with frequency results in the image appearing to be "broken". That is, different frequency components of the image are located at the locations of the different speakers. For example, the sound in the broad frequency band about 500 Hz might appear to emanate from the left speaker, while the sound in the frequency band about 1000 Hz appears to emanate from the right speaker, the sound in the frequency band about 2000 appears to emanate from the left speaker, and so on. This is the result of frequency banding which is imposed by requiring the added phase shift to vary slowly with frequency.

Broadly, it is an object of the present invention to provide an improved apparatus and method for controlling the cross-correlation measure of any two output signals.

It is another object of the present invention to provide an apparatus and method for controlling the cross-correlation measure of two output signals which is capable of producing cross-correlation measures over the full range of possible values.

It is yet another object of the present invention to provide an apparatus and method for controlling the cross-correlation measure of two outputs signals which does not alter the color of the sound.

It is a still further object of the present invention to provide an apparatus and method for controlling the cross-correlation measure of two output signals which does not depend on the program material.

It is yet another object of the present invention to provide a sound broadening apparatus and method which does not produce a sound image which appears to be spatially broken.

These and other objects of the present invention will become apparent to those skilled in the art from the following detailed description of the invention and the accompanying drawings.

SUMMARY OF THE INVENTION

The present invention comprises a method and apparatus for generating first and second output signals having a specified cross-correlation measure from an input signal. The present invention also comprises recordings made from said first and second output signals. The apparatus includes processing circuitry for generating a signal having a value substantially equal to the sum of N-band-limited signals. The $i^{th}$ said band-limited signal has an amplitude substantially equal to that of said input signal in a predetermined frequency range $f_i \pm \delta f_i$ and a phase which differs from the phase of said input signal in said predetermined frequency range by an amount $\phi_i$. Here, i runs from 1 to M, wherein $M > 2$ and $\phi_i$ is chosen between $P - \delta P$ and $P + \delta P$. P and $\delta P$ are determined by said cross-correlation measure.

DETAILED DESCRIPTION OF THE INVENTION

The present invention generates two or more output signals having specified cross-correlation measures. The cross-correlation measure for any pair of output signals may be specified between $-1$ and 1. The present invention operates by manipulation of the phase relationships of the output signals while maintaining a constant magnitude across frequency. The maintenance of a constant magnitude across frequency prevents changes in the colorization of the output signals. The manipulation of the phase relationships creates an interaural phase incoherence which is sufficient to control the cross-correlation measure of the output signals. Reproduction of the processed output signals such that the listener receives one signal at each ear allows one to control the interaural cross-correlation of the sound heard by the listener.

The input signal is typically a monophonic signal or a multi-channel signal which has been summed to form a monophonic input signal. The input signal may also be a stereo signal that contains a single sound element (such as a monophonic track from a mixing console or tape recorder) shared by the two channels or present in only one channel. The stereo input signal may also contain a multiplicity of such single sound elements. Such implementations with two or more input channels will be apparent to those skilled in the art. The input may also be a version of the original input derived through use of techniques such as delay or reverberation. This altered version could be processed with the invention and then combined with the original input. For the purposes of this discussion, it will be assumed that a two-channel output signal, i.e., stereophonic sound, is to be produced. The implementation of embodiments having more than two output channels will be apparent to those skilled in the art from the following discussion.

Figure 1:
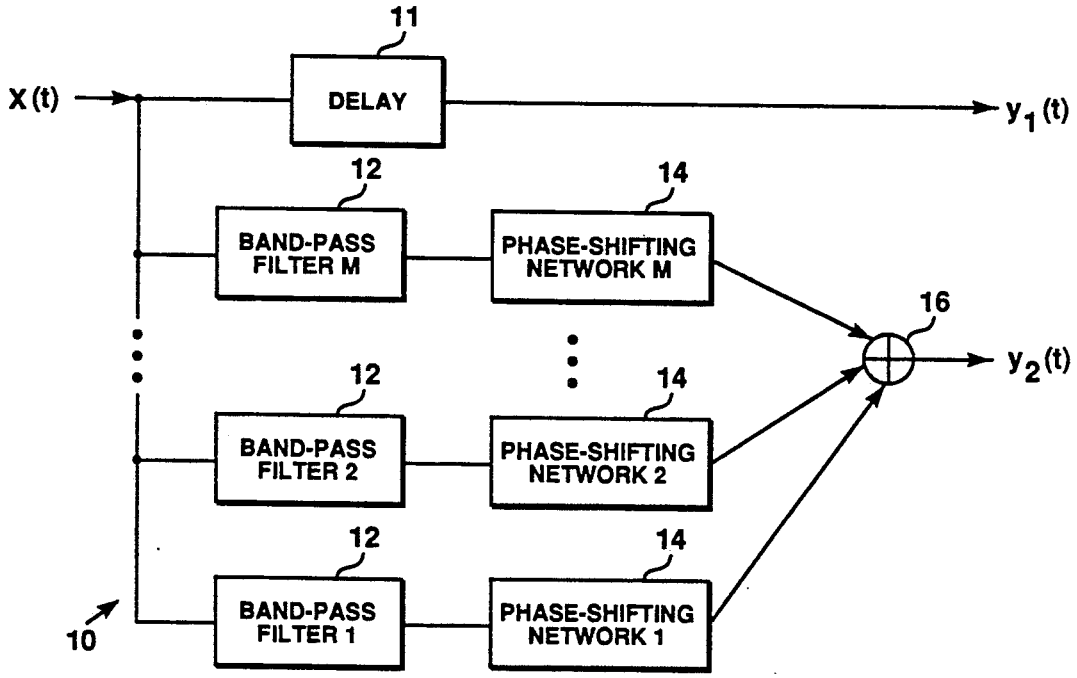
FIG. 1 is a block diagram of an apparatus according to the present invention for converting a monophonic input signal into a stereophonic signal.

The manner in which the present invention operates may be most easily understood with reference to FIG. 1 which illustrates an apparatus 10 for creating two output signals, $y_1(t)$ and $y_2(t)$, from a monophonic input signal x(t). The first output signal $y_1(t)$ is identical to the input signal in the preferred embodiment of the present invention except that it is delayed in time by an amount which compensates for the overall delay introduced by the apparatus into the second output signal. The second output signal is generated by dividing the input signal into M components, each component matching the intensity of the signal in a specific frequency band. Apparatus 10 utilizes a plurality of band-pass filters 12 for this purpose. The signal in the ith frequency band is then phase-shifted by an amount $\phi_i$ utilizing a phase shifting network 14. It is important that each of the band-pass filters preserve the phase of the frequency component of x(t) selected by the filter in question. The phase-shifted signals are then summed by signal adder 16 to form output signal $y_2(t)$.

The cross-correlation measure of the output signals, $y_1(t)$ and $y_2(t)$ is determined by the phase shifts $\phi_i$ that were added to the various frequency components of x(t). In the preferred embodiment of the present invention, the $\phi_i$ are chosen randomly between two limits which will be defined to be $P-\delta P$ and $P+\delta P$, respectively. Other methods for choosing the phase shifts will be described below.

The value of P (modulo $2\pi$) determines the relative balance between the positive and negative peaks in the cross-correlation function. When P is equal to zero, the positive peak is at its maximum (close to 1) and the negative peak is at its minimum (close to 0). When P is equal to $\pi$, the positive peak is at its minimum (close to 0) and the negative peak is at its maximum (close to $-1$). When P is close to $\pi/2$ or $3\pi/2$, the positive and negative peaks are of equal magnitude.

If a positive cross-correlation measure is to be obtained, then $-\pi/2<P<\pi/2$. A negative cross-correlation measure is obtained when $\pi/2<P<3\pi/2$. When P is approximately equal to $-\pi/2$ or $\pi/2$, the negative and positive peaks in the cross-correlation function are very close in magnitude and the cross-correlation measure could be positive or negative, depending upon the specific values of phase shifts utilized.

The manner in which the phase shifts $\phi_i$ are chosen between the limits specified by P and $\delta P$ is important in determining the quality of the output signals. In the preferred embodiment of the present invention, the $\phi_i$ are chosen by generating a sequence of random numbers between the limits in question. Because of the finite number of frequency bands, it is found that different sets of random numbers produce slightly different effects. Hence, in the preferred embodiment of the present invention, a number of different sets of phase shifts are generated and the set producing the best effect, as judged by listening to the output signals, is selected.

Although the preferred embodiment of the present invention utilizes randomly selected phase shifts, other methods of choosing the phase shifts in question may be utilized without departing from the teachings of the present invention. Some of these methods are discussed below. In choosing a set of phase shifts within the range specified by P and $\delta P$, it is important that the phase shifts change direction frequently from band to band. Here, the phase shifts associated with two bands are said to change direction if the signal to the left speaker lags that to the right speaker in the first band while the signal to the left speaker leads that to the second speaker in the second band, or vice versa. As will be discussed in more detail below, this requirement is needed to prevent the perception of a "banded" or "broken" acoustical image as that produced by the device taught by Orban. This requirement can be stated more precisely as follows. Consider three contiguous frequency bands having phase shifts $\phi_i$, $\phi_{i+1}$, and $\phi_{i+2}$. On average, the change in phase shift should not be monotonic. That is, if $\phi_i>\phi_{i+1}$ than, on average, $\phi_{i+1}<\phi_{i+2}$. Similarly, if $\phi_i<\phi_{i+1}$ then, on average, $\phi_{i+1}>\phi_{i+2}$. Clearly, because of the random manner in which the phase shifts are chosen, there will be cases for which three consecutive phase shifts will be monotonic. However, on average this condition should be met.

To better understand the need for this requirement, consider the case in which one wishes to create the illusion of a physically broad sound source emitting sound along its surface between the two speakers. A sound component having a positive phase shift will be perceived as originating from a source which is closer to one speaker. A sound component having a negative phase shift will be perceived as originating from a source which is closer to the other speaker. The exact position at which each of the components is perceived will depend on the magnitude of the phase shift in question. Hence, the present invention produces a sound "image" that appears to emanate from a source that is made up of a collection of discrete sound components, each emitting sound in a specific frequency band and being located at a different position relative to the speakers. This requirement assures that, on average, signals from contiguous frequency bands will be perceived as originating from non-contiguous sources between the speakers.

The distribution of interaural phase shifts will determine the spatial distribution of sound components. If the phase shift distribution is not uniform in phase, the spatial distribution will not be uniform in space. A uniform spatial distribution is desired since it is found experimentally that such a distribution remains uniform when the listener moves from the center line between the loudspeakers to a point off of the center line. For example, when a listener is located left of the center line, sound from the left loudspeaker arrives before sound from the right loudspeaker which introduces a time delay in the arrival sound between the two ears. This time delay affects the phase difference at each frequency differently. A uniform distribution of interaural phase provides the greatest assurance that sound image is not altered by the time delay, since it results in another uniform distribution of interaural phase.

The above discussion deals only with the phase shifts, $\phi_i$. The manner in which the width of the bands is selected will now be discussed. If the bands are too broad, the listener will perceive a broken or banded image. The device taught by Orban has precisely this problem.

However, if the bands are too narrow, the broadening of the image will be reduced.

It is known from psychoacoustical research that there is a critical bandwidth below which the human ear can not discriminate. The critical bandwidth depends on frequency, varying from approximately 100 Hz at low frequencies (<2000 Hz) to approximately one seventh the center frequency of the band in question at high frequencies (<2000 Hz).

Consider a band of critical bandwidth centered at a frequency F. If the frequency bands utilized in the present invention are much smaller than the critical bandwith, then the critical frequency band in question will be made-up of a plurality of sub-bands, each with a different phase shift, $\phi_i$. The critical band in question will have an apparent phase shift which is an average of these phase shifts. That is, the listener will perceive a single band having an effective interaural phase shift whose value is the average of the individual interaural phase shifts.

This averaging of the phase shifts has the effect of reducing the apparent variation in the added phase shifts. As noted above, the preferred embodiment of the present invention controls the cross-correlation measure of the output signals by adding interaural phase shifts having values between $P-\delta P$ and $P+\delta P$. If several of these phase shifts are averaged to form a single apparent phase shift, the effective phase shifts will have a Gaussian distribution centered at P with a standard deviation considerably less than $\delta P$. Hence, the apparent cross-correlation measure will be different from the desired one if the bandwidths are considerably less than a critical bandwidth.

From the above discussion, it will be apparent to those skilled in the art that the minimum effective bandwidth should be equal to the critical bandwidth. Low bandwidths, such as 50 Hz, are able to produce cross-correlation measures closest to zero. However, it has been found experimentally, that the present invention operates satisfactorily with bandwidths which are as low as 50 Hz and as large as four times the critical bandwith.

The above described embodiments of the present invention utilize band-pass filters and phase shift circuits. The same result may be obtained, however, by convolving x(t) with a filter function h(t) to produce $y_2(t)$. That is, $$y_2(t)=\int x(t-z)h(z)dz \quad (2).$$

The transformation function h(t) provides the phase shifting of the individual frequency bands.

The present invention preferably utilizes a digital input signal. If the signal source consists of an analog signal, it may be converted to digital form via a conventional analog-to-digital converter. In this case, each output signal consists of a sequence of digital values. The ith value for each output signal corresponds to the value of the output signal at a time iT, where T is the time between digital samples. In this case, the convolution operation given in Eq. (2) reduces to $$y_2(nT)=y_n=\Sigma_m x_{n-m}h_m, \quad (3)$$

where the filter coefficients, $h_m$ are calculated from $$h_m=(1/N)\Sigma_m \exp(kmw+\phi_k) \quad (4).$$

Here, k runs from 0 to $N-1$, $w=2\pi/N$, $\exp(z)=e^{jZ}$, and N is the total number of frequency samples.

In the above described preferred embodiment of the present invention, only one of the output signals is obtained from the input signal by processing the input signal, the other output signal being identical to the input signal. The output signal that is identical to the input signal can be delayed in time to compensate for the overall delay introduced by the processing. In the case that the processing is performed by convolution, this delay will be approximately equal to half the length of the convolution sequence.

It will be apparent to those skilled in the art that both $y_1(t)$ and $y_2(t)$ could be generated from x(t) by convolving x(t) with different filter functions. Each filter would be based on a different set of phase shifts such that phase differences producing the desired cross-correlation would be introduced to the two outputs $y_1(t)$ and $y_2(t)$. For the purposes of this discussion, the phase used to generate $y_1(t)$ will be denoted by ${}^1\phi_i$ and those used to generate $y_2(t)$ will be denoted by ${}^2\phi_i$. In this case, the filter functions would be chosen such that the average value of the ${}^1\phi_i$ differed from the average value of the ${}^2\phi_i$ by P and the average value of $({}^1\phi_i-{}^2\phi_i)$ is $\delta P$.

For practically realizable values of N, the transformations utilized to produce $y_1(t)$ and $y_2(t)$ produce a perceptible timbre change. In the preferred embodiment of the invention, one processed output minimizes the timbral change in the stereo result. Nonetheless, there are applications that benefit from two processed outputs.

The above described procedures enable one to produce output signals having a cross-correlation measure very close to any specified value less than −0.4 or greater than 0.4. For cross-correlation measures between −0.4 and 0.4 and finite values of N, a cross-correlation measure in this range may not always be obtainable, especially for highly deterministic input signals. For a given set of randomly chosen phase shifts, it is sometimes found that the cross-correlation function exhibits similar positive and negative peaks near zero. Since the cross-correlation measure is the extreme value of the cross-correlation function, a cross-correlation measure of zero is not always possible. Hence, if a cross-correlation measure between these values is required, several different sets of phase shifts may need to be examined. Alternatively, increased values of N may be needed.

However, it should be noted that the auditory system does not discriminate very well among cross-correlation measures near zero. As a result, the variance between the prescribed and obtained cross-correlation is of little consequence in the region between −0.4 and 0.4. On the other hand, the auditory system is quite sensitive to differences in cross-correlation measures near ±1, and here the match between prescribed and generated cross-correlation measures is quite good utilizing the apparatus and method of the present invention.

The number of frequency samples N directly specified in the frequency domain and used to create the incoherent time-domain signal is limited by the number of points of the time-domain signal. Typically, these points are linearly spaced across frequency. The filter coefficients that result from using the inverse Fast Fourier Transform given in Eq. (4) will deviate from the constant magnitude spectrum frequencies between the specified frequency points. As a result, the goal of a constant magnitude spectrum is only completely accomplished if N is very large in the above described equations. There is a practical limit to the size of N in commerically realizable apparatuses.

In addition, to achieve a completely constant magnitude spectrum, the integral given in Eq. (2) must be performed from $-\infty$ to $+\infty$. However, in practice, the maximum acceptable convolution time is of the order of 20 msec. If longer times are chosen, transient properties of the input signal are perceptibly smeared in time. On the other hand, restrictions on the time window of the convolution sequence limit the range of phase shifts for very low frequencies. Timbral neutrality depends both on the spectral flatness and the clarity of transients. Hence, for any given sampling rate, there is a trade-off between timbral neutrality and the effect at low frequencies.

As noted above, the present invention minimizes the effects of this trade-off by providing the unprocessed sound as one of the output channels. In addition, these effects can be further minimized by the particular random number sequence used in generating the phase shifts. It has been found experimentally that different sets of phase shifts, $\{\phi_k\}$, produce different subjective effects on listeners. In the preferred embodiment of the present invention, a number of different sets of phase shifts are generated and the one which provides the desired subjective effect is chosen.

Figure 2:
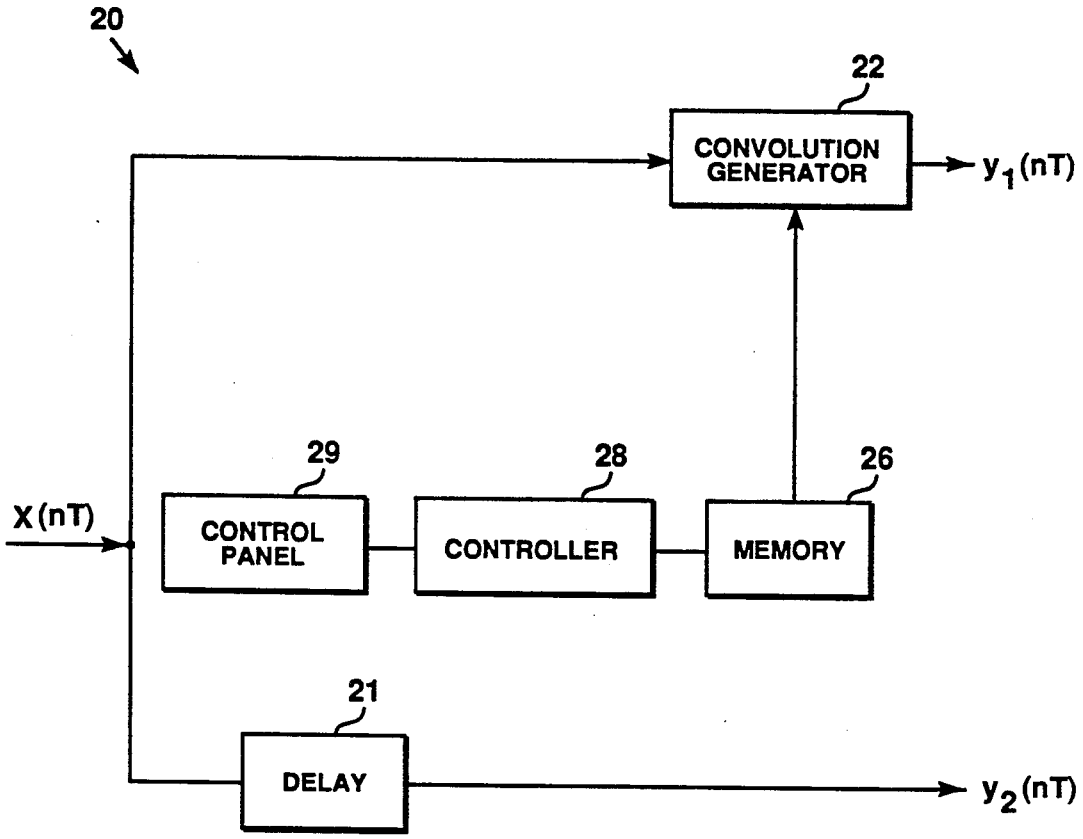
FIG. 2 is a block diagram of the preferred embodiment of an apparatus according to the present invention.

A block diagram of an apparatus according to the present invention for generating two output signals, $y_1(nT)$ and $y_2(nT)$, which utilizes the convolution approach is shown in FIG. 2 at 20. Apparatus 20 includes a convolution generator 22 for convolving a digital input signal $x(nT)$ with a set of filter coefficients, $\{h_n\}$. Various sets of filter coefficients are stored in memory 26. The particular set utilized by generator 22 is determined by inputting data specifying the desired image width and distance to controller 28 which preferably includes a control panel 29 for this purpose. A delay circuit 21 is included to compensate for the overall time delay introduced by convolution generator 22.

In the preferred embodiment, the cross-correlation measure value is determined by the relationship of the processed output channel to the unprocessed output channel. Those skilled in the art will also recognize that the same interchannel relationship can be achieved in an implementation in which both output signals are processed. In such an implementation, the phase characteristics we have described for the processed signal in the preferred embodiment are implemented such that the interchannel phase differences satisfy the conditions in question.

Although the above embodiments of the present invention have been described with reference to stereophonic output signals, it will apparent to those skilled in the art that the principles described above may be utilized for providing more than two output signals. For example, in theatrical sound systems four or more output channels are often utilized. Each of the output channels can be processed by an apparatus according to the present invention.

Unlike prior art systems, the perceptual effects obtained with the present invention are resilient in loudspeaker reproduction, even when the listeners are far off the line equidistant between the two loudspeakers and even when the reproduction environment is reverberant. Experiments have shown that the effect is present even when the distance between the listener and each of the loudspeakers differs by as much as 15 meters in typical reproduction settings.

The output signals provided by the present invention may be played through conventional speakers or headphones. These signals may also be recorded onto conventional stereophonic recording media for subsequent playback through conventional stereophonic equipment.

While the above embodiments have been described in terms of all of the phase shifts being within predetermined limits, it will be apparent to those skilled in the art that the present invention will function satisfactorily if some of the phase shifts are outside the limits in question. Similarly, any substantially random sequence of phase shifts will perform satisfactorily in the preferred embodiment described above.

There has been described herein a novel apparatus and method for converting a monophonic input signal into a plurality of output signals in which the cross-correlation measure of any pair of output signals may be specified. Various modifications to the present invention will become apparent to those skilled in the art from the foregoing description and accompanying drawings. Accordingly, the present invention is to be limited solely by the scope of the following claims.

What is claimed is:

1. An apparatus for generating from an input signal first and second output signals having a cross-correlation measure, said apparatus comprising:

means for receiving said input signal;

processing means for generating a processed signal having a value substantially equal to the sum of N band-limited signals, the ith said band-limited signal having an intensity substantially equal to that of said input signal in a predetermined frequency range $f_i+\delta f_i$ and a phase which differs from the phase of said input signal in said predetermined frequency range by an amount $\phi_i$, i running from 1 to M, wherein $M>2$ and $\phi_i$ is a substantially random sequence;

means for generating said first output signal from said processed signal;

wherein said second output signal is substantially identical to said input signal delayed by a predetermined time delay.

2. An apparatus for generating from an input signal first and second output signals having a cross-correlation measure, said apparatus comprising:

means for receiving said input signal;

processing means for generating a processed signal having a value substantially equal to the sum of N band-limited signals, the ith said band-limited signal having an intensity substantially equal to that of said input signal in a predetermined frequency range $f_i+\delta f_i$ and a phase which differs from the phase of said input signal in said predetermined frequency range by an amount $\phi_i$, i running from 1 to M, wherein $M>2$ and $\phi_i$ is a substantially random sequence; and means for generating said first output signal from said processed signal;

wherein said input signal and said output signals comprise sequences of digital values measured at intervals of length T and wherein said processing comprises means for forming the sum $$\Sigma x_{n-m}h_m,$$

wherein $$h_m=(1/N)\Sigma\exp(kmwT+\phi_k),$$

m runs from 0 to N−1, $w=2\pi/N$, and $x_n$ is the value of said input signal at time nT.

3. The apparatus of claim 2 wherein said $\phi_k$ comprise a sequence of random numbers.

4. A method for generating first and second output signals, having a cross-correlation measure from an input signal, said method comprising:

receiving said input signal;

processing said input signal to generate a processed signal having a value substantially equal to the sum of N band-limited signals, the ith said band-limited signal having an intensity substantially equal to that of said input signal in a predetermined frequency range $f_i+\delta f_i$ and a phase which differs from the phase of said input signal in said predetermined frequency range by an amount $\phi_i$, i running from 1 to M, wherein $M>2$ and $\phi_i$ is a substantially random sequence;

generating said first output signal from said processed signal; and wherein said second output signal is substantially identical to said input signal delayed by a predetermined time delay.

5. A method for generating first and second output signals, having a cross-correlation measure from an input signal, said method comprising:

receiving said input signal;

processing said input signal to generate a processed signal having a value substantially equal to the sum of N band-limited signals, the ith said band-limited signal having an intensity substantially equal to that of said input signal in a predetermined frequency range $f_i+\delta f_i$ and a phase which differs from the phase of said input signal in said predetermined frequency range by an amount $\phi_i$, i running from 1 to M, wherein $M>2$ and $\phi_i$ is a substantially random sequence;

generating said first output signal from said processed signal; and wherein said input signal and said output signals comprise sequences of digital values measured at intervals of length T and wherein said processing step comprise forming the sum $$\Sigma x_{n-m}h_m,$$

wherein $$h_m=(1/N)\Sigma\exp(kmwT+\phi_k),$$

m runs from 0 to N−1, $w=2\pi/N$, and $x_n$ is the value of said input signal at time nT.

6. Audio processing apparatus for processing an input audio signal, said apparatus comprising:

means for receiving said input signal;

processing means for generating a processed signal having a value substantially equal to the sum of N band-limited signals, the ith said band-limited signal having an intensity of substantially constant proportionality to that of said input signal in a frequency range $f_i+\delta f_i$ and a phase which differs from the phase of said input signal in said predetermined frequency range by an amount $\phi_i$, i running from 1 to M, wherein $M>2$ and $\phi_i$ is a sequence of phase shift amounts which is substantially random;

means for generating an output signal from said processed signal; and means for generating an additional output signal substantially identical to the input signal delayed by a predetermined time delay.

7. Audio processing apparatus for processing an input audio signal, said apparatus comprising:

means for receiving said input signal;

processing means for generating a processed signal having a value substantially equal to the sum of N band-limited signals, the ith said band-limited signal having an intensity of substantially constant proportionality to that of said input signal in a frequency range $f_i+\delta f_i$ and a phase which differs from the phase of said input signal in said predetermined frequency range by an amount $\phi_i$, i running from 1 to M, wherein $M>2$ and $\phi_i$ is a sequence of phase shift amounts which is substantially random;

means for generating an output signal from said processed signal; and wherein said input signal and said output signal comprise sequences of digital values measured at intervals of length T and wherein said processing means comprises means for forming the sum $$\Sigma x_{n-m}h_m,$$

wherein $$h_m=(1/N)\Sigma\exp(kmwT+\phi_k),$$

m runs from 0 to N−1, $w=2\pi/N$, and $x_n$ is the value of said input signal at time nT.

8. The apparatus of claim 7 wherein said $\phi_k$ comprise a sequence of substantially random numbers.

9. A method for audio processing of an input audio signal, said method comprising:

receiving said input signal;

processing said input signal to generate a processed signal having a value substantially equal to the sum of N band-limited signals, the ith said band-limited signal having an intensity of substantially constant proportionality to that of said input signal in a predetermined frequency range $f_i+\delta f_i$ and a phase which differs from the phase of said input signal in said predetermined frequency range by an amount $\phi_i$, i running from 1 to M, wherein $M>2$ and $\phi_i$ is a sequence of phase shift amounts which is substantially random;

generating an output signal from said processed signal; and generating an additional output signal substantially identical to the input signal delayed by a predetermined time delay.

10. A method for audio processing of an input audio signal, said method comprising:

receiving said input signal;

processing said input signal to generate a processed signal having a value substantially equal to the sum of N band-limited signals, the ith said band-limited signal having an intensity of substantially constant proportionality to that of said input signal in a predetermined frequency range $f_i+\delta f_i$ and a phase which differs from the phase of said input signal in said predetermined frequency range by an amount $\phi_i$, i running from 1 to M, wherein $M>2$ and $\phi_i$ is a sequence of phase shift amounts which is substantially random;

generating an output signal from said processed signal;

wherein said input signal and said output signal comprise sequences of digital values measured at intervals of length T and wherein said processing step comprise forming the sum $$\Sigma x_{n-m} h_m,$$

wherein $$h_m = (1/N)\Sigma \exp(kmwT + \phi_k),$$

m runs from 0 to N−1, $w = 2\pi/N$, and $x_n$ is the value of said input signal at time nT.

11. Audio processing apparatus for processing an input signal, said apparatus comprising:

means for receiving said input signal;

processing means for convolving the input signal with a filter function h(z) to provide a processed signal having a value substantially equal to the sum of N band-limited signals, the ith said band-limited signal having an intensity of substantially constant proportionality to that of said input signal in a frequency range $f_i + \delta f_i$ and a phase which differs from the phase of said input signal in said predetermined frequency range by an amount $\phi_i$, i running from 1 to M, wherein M>2;

means for generating an output signal from said processed signal; and means for generating an additional output signal substantially identical to the input signal delayed by a predetermined time delay.

12. Audio processing apparatus for processing an input signal, said apparatus comprising:

means for receiving said input signal;

processing means for convolving the input signal with a filter function h(z) to provide a processed signal having a value substantially equal to the sum of N band-limited signals, the ith said band-limited signal having an intensity of substantially constant proportionality to that of said input signal in a frequency range $f_i + \delta f_i$ and a phase which differs from the phase of said input signal in said predetermined frequency range by an amount $\phi_i$, i running from 1 to M, wherein M>2; and means for generating an output signal from said processed signal;

wherein said input signal and said processed signal comprise sequences of digital values measured at intervals of length T and wherein said processing means comprises means for forming the sum $$\Sigma x_{n-m} h_m,$$

wherein $$h_m = (1/N)\Sigma \exp(kmwT + \phi_k),$$

m runs from 0 to N−1, $w = 2\pi/N$, and $x_n$ is the value of said input signal at time nT.

13. The apparatus of claim 12 wherein the input signal is one of a pair of stereo signals.

14. The apparatus of claim 12 wherein said $\phi_i$ changes direction frequently from band to band.

15. The apparatus of claim 12 further comprising means for generating an additional output signal substantially identical to the input signal delayed by a predetermined time delay.

16. A method for generating an output signal from an input signal, said method comprising:

receiving said input signal;

convolving said input signal with a filter function h(z) to generate a processed signal having a value substantially equal to the sum of N band-limited signals, the ith said band-limited signal having an intensity of substantially constant proportionality to that of said input signal in a predetermined frequency range $f_i + \delta f_i$ and a phase which differs from the phase of paid input signal in said predetermined frequency range by an amount $\phi_i$, i running from 1 to M, wherein M>2;

generating said output signal from said processed signal;

wherein said input signal and said processed signal comprise sequences of digital values measured at intervals of length T and wherein said convolving step comprises forming the sum $$\Sigma x_{n-m} h_m,$$

wherein $$h_m = (1/N)\Sigma \exp(kmwT + \phi_k),$$

m runs from 0 to N−1, $w = 2\pi/N$, and $x_n$ is the value of said input signal at time nT.

17. The method of claim 16 wherein said $\phi_i$ changes direction frequently from band to band.

18. A method for generating an output signal from an input signal, said method comprising:

receiving said input signal;

convolving said input signal with a filter function h(z) to generate a processed signal having a value substantially equal to the sum of N band-limited signals, the ith said band-limited signal having an intensity of substantially constant proportionality to that of said input signal in a predetermined frequency range $f_i + \delta f_i$ and a phase which differs from the phase of said input signal in said predetermined frequency range by an amount $\phi_i$, i running from 1 to M, wherein M>2;

generating said output signal from said processed signal; and generating an additional output signal substantially identical to the input signal delayed by a predetermined time delay.

19. A recording made by the process comprising the steps of:

receiving at least one input signal;

convolving at least one of said input signals with a filter function h(z) to generate a processed signal having a value substantially equal to the sum of N band-limited signals, the ith said band-limited signal having an intensity of substantially constant proportionality to that of said input signal in a predetermined frequency range $f_i + \delta f_i$ and a phase which differs from the phase of said input signal in said predetermined frequency range by an amount $\phi_i$, i running from 1 to M, wherein M>2;

generating an output signal from the processed signal; and recording the output signal;

wherein said input signal and said processed signal comprise sequences of digital values measured at intervals of length T and wherein said convolving step comprise forming the sum $$\Sigma x_{n-m} h_m,$$

wherein $$h_m = (1/N)\Sigma \exp(kmwT + \phi_k),$$

m runs from 0 to N−1, $w = 2\pi/N$, and $x_n$ is the value of said input signal at time nT.

20. The recording of claim 19 wherein said $\phi_i$ changes direction frequently from band to band.

21. A recording made by the process comprising the steps of:

receiving at least one input signal;

convolving at least one of said input signals with a filter function h(z) to generate a processed signal having a value substantially equal to the sum of band-limited signals, the ith said band-limited signal having an intensity of substantially constant proportionality to that of said input signal in a predetermined frequency range $f_i + \delta f_i$ and a phase which differs from the phase of said input signal in said predetermined frequency range by an amount $\phi_i$, i running from 1 to M, wherein M>2;

generating an output signal from the processed signal; and recording the output signal;

wherein the process further comprising the steps of generating an additional output signal substantially identical to the input signal delayed by a predetermined time delay and recording the additional output signal.

22. A recording made by the process comprising the steps of:

receiving at least one input signal;

processing at least one of the input signals to generate a processed signal having a value substantially equal to the sum of N band-limited signals, the ith said band-limited signal having an intensity of substantially constant proportionality to that of said input signal in a predetermined frequency range $f_i + \delta f_i$ and a phase which differs from the phase of said input signal in said predetermined frequency range by an amount $\phi_i$, i running from 1 to M, wherein M>2 and $\phi_i$ is a sequence of phase shift amounts which is substantially random;

generating an output signal from said processed signal; and recording the output signal;

wherein the process further comprises the steps of generating an additional output signal substantially identical to the input signal delayed by a predetermined time delay and recording the additional output signal.

23. A recording made by the process comprising the steps of:

receiving at least one input signal;

processing at least one of the input signals to generate a processed signal having a value substantially equal to the sum of N band-limited signals, the ith said band-limited signal having an intensity of substantially constant proportionality to that of said input signal in a predetermined frequency range $f_i + \delta f_i$ and a phase which differs from the phase of said input signal in said predetermined frequency range by an amount $\phi_i$, i running from 1 to M, wherein M>2 and $\phi_i$ is a sequence of phase shift amounts which is substantially random;

generating an output signal from said processed signal; and recording the output signal;

wherein said input signal and said processed signal comprise sequences of digital values measured at intervals of length T and wherein said processing step comprise forming the sum $$\Sigma x_{n-m} h_m,$$

wherein $$h_m = (1/N)\Sigma \exp(kmwT + \phi_k),$$

m runs from 0 to N−1, $w = 2\pi/N$, and $x_n$ is the value of said input signal at time nT.

* * * * *

UNITED STATES PATENT AND TRADEMARK OFFICE

CERTIFICATE OF CORRECTION

PATENT NO. : 5,235,646
DATED : August 10, 1993
INVENTOR(S) : Wilde, et. al.

It is certified that error appears in the above-indentified patent and that said Letters Patent is hereby corrected as shown below:

Column 7, line 9, delete "(<2000 Hz)" and insert -- (<2000 Hz)--;

Signed and Sealed this

Nineteenth Day of July, 1994

*Attest:*

Bruce Lehman

BRUCE LEHMAN

*Attesting Officer*

*Commissioner of Patents and Trademarks*